US008726861B2

(12) United States Patent
Choi et al.

(10) Patent No.: US 8,726,861 B2
(45) Date of Patent: May 20, 2014

(54) VARIABLE VALVE LIFT APPARATUS

(75) Inventors: Byong Young Choi, Incheon-si (KR); Jin Kook Kong, Suwon-si (KR); Soo Hyung Woo, Yongin-si (KR); Young Hong Kwak, Suwon-si (KR); Gee Wook Shin, Hwaseong-si (KR); Jei Choon Yang, Yongin-si (KR); Chang Ho Yang, Osan-si (KR)

(73) Assignee: Hyundai Motor Company, Seoul (KR)

( * ) Notice: Subject to any disclaimer, the term of this patent is extended or adjusted under 35 U.S.C. 154(b) by 356 days.

(21) Appl. No.: 12/948,514

(22) Filed: Nov. 17, 2010

(65) Prior Publication Data

US 2012/0048219 A1 Mar. 1, 2012

(30) Foreign Application Priority Data

Sep. 1, 2010 (KR) ..... 10-2010-0085675

(51) Int. Cl.
*F01L 1/34* (2006.01)
*F01L 1/04* (2006.01)
*F01L 1/14* (2006.01)

(52) U.S. Cl.
USPC ..... 123/90.16; 123/90.18; 123/90.48; 123/90.6

(58) Field of Classification Search
USPC ..... 123/90.16–90.17, 90.48, 90.6
See application file for complete search history.

(56) References Cited

U.S. PATENT DOCUMENTS

| | | | | | |
|---|---|---|---|---|---|
| 4,794,893 | A | * | 1/1989 | Masuda et al. | 123/90.17 |
| RE33,411 | E | * | 10/1990 | Inoue et al. | 123/198 F |
| 5,158,049 | A | * | 10/1992 | Neumann | 123/90.17 |
| 5,186,128 | A | * | 2/1993 | Murata et al. | 123/90.16 |
| 5,239,885 | A | * | 8/1993 | Voigt | 74/567 |
| 5,320,082 | A | * | 6/1994 | Murata et al. | 123/90.16 |
| 5,329,895 | A | * | 7/1994 | Nishida et al. | 123/90.17 |
| 5,331,866 | A | * | 7/1994 | Voight et al. | 74/567 |
| 5,345,898 | A | * | 9/1994 | Krebs | 123/90.17 |
| 5,367,991 | A | * | 11/1994 | Asai et al. | 123/90.16 |
| 5,429,079 | A | * | 7/1995 | Murata et al. | 123/90.16 |
| 5,501,121 | A | * | 3/1996 | Beier et al. | 74/568 R |
| 5,645,022 | A | * | 7/1997 | Yamamoto et al. | 123/90.17 |
| 5,832,889 | A | * | 11/1998 | Naruoka et al. | 123/90.18 |
| 6,135,078 | A | * | 10/2000 | Doi et al. | 123/90.18 |
| 6,343,581 | B2 | * | 2/2002 | Suzuki | 123/90.17 |
| 6,401,677 | B1 | * | 6/2002 | Rohe et al. | 123/90.16 |
| 6,427,653 | B1 | * | 8/2002 | Hara et al. | 123/90.17 |
| 6,474,281 | B1 | * | 11/2002 | Walters | 123/90.18 |
| 6,854,432 | B2 | * | 2/2005 | Hirano | 123/90.16 |
| 6,968,814 | B2 | * | 11/2005 | Battlogg | 123/90.16 |
| 2002/0073948 | A1 | * | 6/2002 | Battlogg | 123/90.16 |

(Continued)

FOREIGN PATENT DOCUMENTS

WO WO 2008101784 A1 * 8/2008

*Primary Examiner* — Thomas Denion
*Assistant Examiner* — Steven D Shipe
(74) *Attorney, Agent, or Firm* — Morgan, Lewis & Bockius LLP

(57) ABSTRACT

A variable valve lift apparatus may include a camshaft, a low lift cam which may be connected to the camshaft and rotates, a high lift cam which may be rotatably mounted to the camshaft and may be selectively connected to the camshaft to rotate with the camshaft, a high lift cam connecting portion which selectively connects the high lift cam to the camshaft, and a tappet including a low lift cam contact portion contacting the low lift cam and a high lift cam contact portion selectively activating the high lift cam.

8 Claims, 5 Drawing Sheets

(56) References Cited

U.S. PATENT DOCUMENTS

2002/0170514 A1* 11/2002 Methley ..... 123/90.16
2006/0011161 A1* 1/2006 Lechner et al. ..... 123/90.17
2008/0115750 A1* 5/2008 Hahn et al. ..... 123/90.17
2008/0257290 A1* 10/2008 Lettmann et al. ..... 123/90.17
2009/0090320 A1* 4/2009 Kim et al. ..... 123/90.16
2009/0183700 A1* 7/2009 Evans et al. ..... 123/90.11

* cited by examiner

VARIABLE VALVE LIFT APPARATUS

CROSS-REFERENCE TO RELATED APPLICATION

The present application claims priority to Korean Patent Application No. 10-2010-0085675 filed in the Korean Intellectual Property Office on Sep. 1, 2010, the entire contents of which is incorporated herein for all purposes by this reference.

BACKGROUND OF THE INVENTION

1. Field of the Invention

The present invention relates to a variable valve lift apparatus. More particularly, the present invention relates to a variable valve lift apparatus which may adjust valve lift according to engine operation condition with simple scheme.

2. Description of Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. In order to achieve such an optimal valve operation depending on the rotation speed of the engine, various researches have been undertaken. For example, research has been undertaken for a variable valve lift (VVL) apparatus that enables different lifts depending on an engine speed, and for a variable valve timing (VVT) apparatus that opens/closes the valves with different timing depending on the engine speed.

However, a conventional variable valve lift requires complicated hydraulic lines and a plurality of element for operating, and also total height of an engine is caused to be increased.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable valve lift apparatus which may adjust valve lift according to engine operation condition with simple scheme.

In an aspect of the present invention, the variable valve lift apparatus may include a camshaft, a low lift cam which may be connected to the camshaft and rotates, a high lift cam which may be rotatably mounted to the camshaft and may be selectively connected to the camshaft to rotate with the camshaft, a high lift cam connecting portion which selectively connects the high lift cam to the camshaft, and a tappet comprising a low lift cam contact portion contacting the low lift cam and a high lift cam contact portion selectively activating the high lift cam.

The high lift cam connecting portion may include an oil supply line formed in the camshaft having a latching pin guide hole, a latching pin hole formed to the high lift cam, and a latching pin which may be supplied hydraulic pressure from the oil supply line and may be selectively locked into the latching pin hole of the high lift cam through the latching pin guide hole of the camshaft.

The high lift cam connecting portion further may include a penetrating slot formed to the latching pin in a longitudinal direction thereof, an guide pin which may be inserted into the penetrating slot along vertical direction of the moving direction of the latching pin and connected to inner surface of the camshaft, and a return spring which may be disposed within the latching pin and elastically biases the latching pin against the guide pin.

The high lift cam contact portion may include a slanted portion which may be protruded from the low lift cam contact portion and shaped as a curved surface, and an exterior surface of the high lift cam may be slanted corresponding to the slanted portion.

The variable valve lift apparatus may further include a lost motion spring disposed to the camshaft for elastically supporting the high lift cam, wherein the high lift cam may be disposed as plural, and the lost motion spring may be disposed between the high lift cams, wherein the low lift cam may be disposed as a pair, and a low lift cam connecting portion connects the low lift cams, and wherein the tappet may be disposed as plural, and each low lift cam contact portion may be oppositely disposed.

In another aspect of the present invention, the variable valve lift apparatus may include a camshaft, a plurality of tappet comprising a low lift cam contact portion and a high lift cam contact portion protruded from the low lift cam contact portion and slantedly formed, a plurality of low lift cam which may be connected to the camshaft, rotates, and selectively contacts the low lift cam contact portion, a plurality of high lift cam which may be rotatably mounted to the camshaft, contacts the high lift cam contact portion, may be selectively connected to the camshaft and rotates, and of which an exterior surface may be slantedlly formed, a high lift cam connecting portion which selectively connects the high lift cam and the camshaft, and a lost motion spring disposed to the camshaft for elastically supporting the high lift cam.

The high lift cam connecting portion may include an oil supply line formed in the camshaft having a latching pin guide hole, a latching pin hole formed to the high lift cam, a latching pin which may be supplied hydraulic pressure from the oil supply line and may be selectively locked into the latching pin hole of the high lift cam through the latching pin guide hole of the camshaft, a penetrating slot formed to the latching pin in a longitudinal direction thereof, an guide pin which may be inserted into the penetrating slot along vertical direction of the moving direction of the latching pin and connected to inner surface of the camshaft, and a return spring which may be disposed within the latching pin and elastically biases the latching pin against the guide pin.

The lost motion spring may be disposed between the high lift cams for elastically supporting two abutting high lift cams.

The low lift cams as a pair may be connected by a low lift cam connecting portion, and each low lift cam contact portion may be oppositely disposed.

As described above, a variable valve lift apparatus according to the exemplary embodiment of the present invention may adjust valve lift according to engine operation condition with simple scheme and lower height of the an engine so that the variable valve lift apparatus may be applied to a conventional engine without excessive design change.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
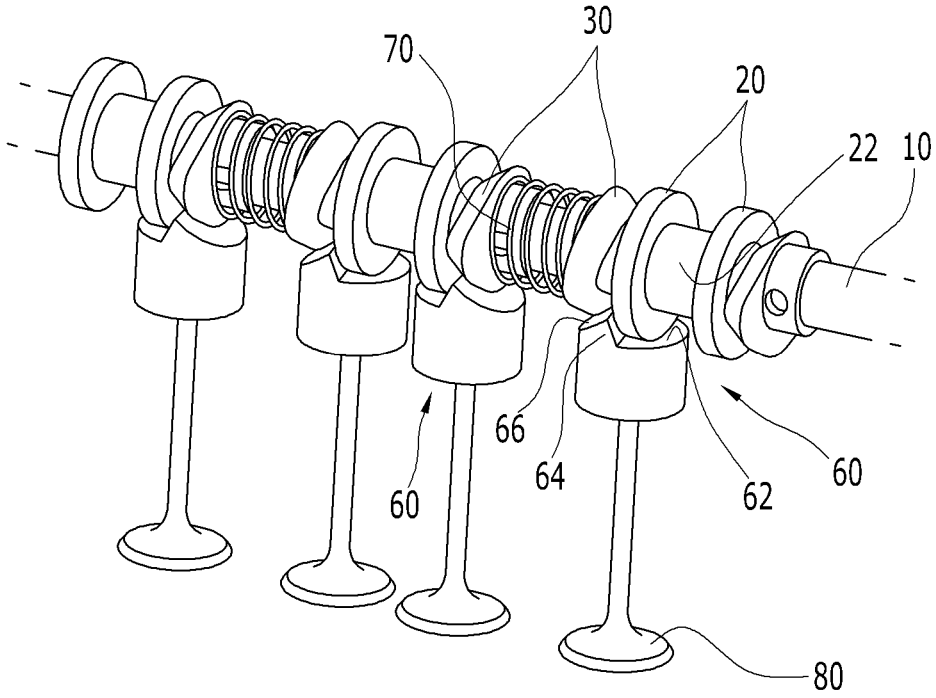
FIG. 1 is a perspective view of a variable valve lift apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Figure 2:
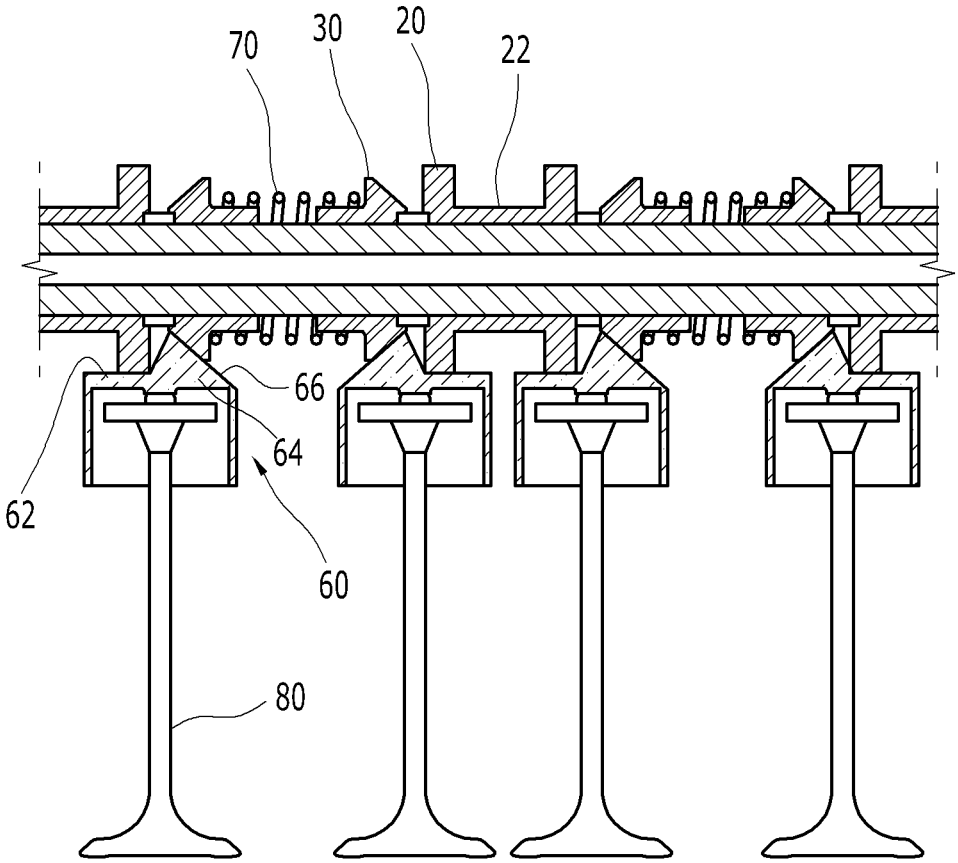
FIG. 2 is a cross-sectional view of a variable valve lift apparatus according to an exemplary embodiment of the present invention.

FIG. 1 is a perspective view of a variable valve lift apparatus according to an exemplary embodiment of the present invention, and FIG. 2 is a cross-sectional view of a variable valve lift apparatus according to an exemplary embodiment of the present invention.

Figure 3:
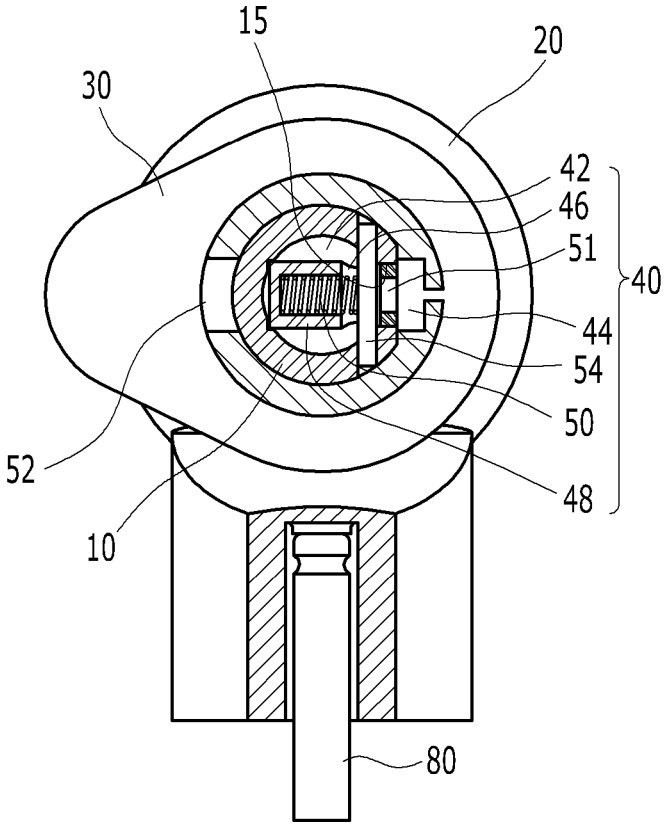
FIG. 3 is a cross-sectional view of a high lift cam connecting portion of a variable valve lift apparatus according to an exemplary embodiment of the present invention.

FIG. 3 is a cross-sectional view of a high lift cam connecting portion of a variable valve lift apparatus according to an exemplary embodiment of the present invention.

Figure 4:
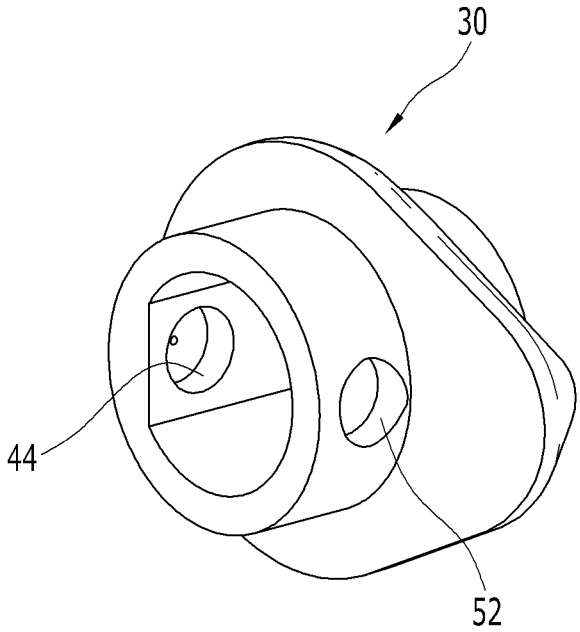
FIG. 4 is a perspective view of a high lift cam of a variable valve lift apparatus according to an exemplary embodiment of the present invention.
Figure 5:
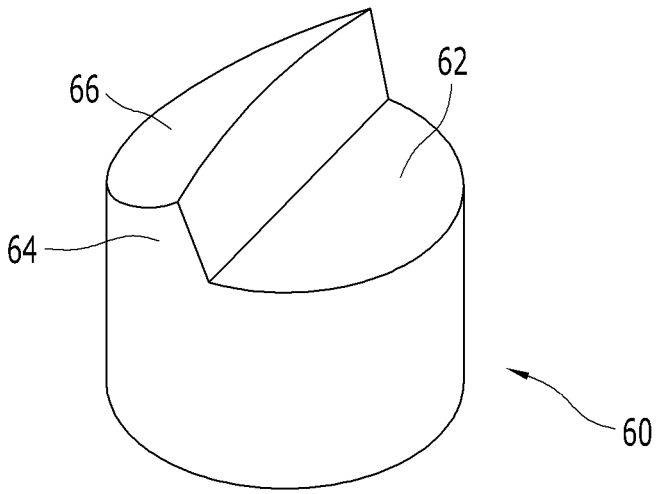
FIG. 5 is a perspective view of a tappet of a variable valve lift apparatus according to an exemplary embodiment of the present invention.

FIG. 4 is a perspective view of a high lift cam of a variable valve lift apparatus according to an exemplary embodiment of the present invention, and FIG. 5 is a perspective view of a tappet of a variable valve lift apparatus according to an exemplary embodiment of the present invention.

Referring to FIG. 1 to FIG. 5, a variable valve lift apparatus according to an exemplary embodiment of the present invention includes a camshaft 10, a low lift cam 20 which is connected to the camshaft 10 and rotates, a high lift cam 30 which is disposed to the camshaft 10 and is selectively connected to the camshaft 10 and rotates, a high lift cam connecting portion 40 which selectively connects the high lift cam 30 and the camshaft 10, and a tappet 60 including a low lift cam contact portion 62 selectively contacting the low lift cam 20 and a high lift cam contact portion 64 contacting the high lift cam 30.

The high lift cam connecting portion 40 includes an oil supply line 42 formed to the camshaft 10, a latching pin hole 44 formed to the high lift cam 30, and a latching pin 48 which is supplied hydraulic pressure from the oil supply line 42 and is selectively inserted into the latching pin hole 44.

The high lift cam connecting portion 40 may further include a penetrating slot 46 formed to the latching pin 48, an guide pin 54 which is inserted into the penetrating slot 46 along vertical direction of the moving direction of the latching pin 48 and guide the latching pin 48 when the latching pin 48 slidably moves through a latching pin guide hole 15, and a return spring 50 which is disposed within the latching pin 48 and elastically supports the latching pin 48 against the guide pin 54.

The high lift cam contact portion 62 includes a slanted portion 66 which is protruded from the low lift cam contact portion 62 and shaped as a curved surface, and an exterior surface of the high lift cam 30 is slanted according to the slanted portion 66.

The apparatus further includes a lost motion spring 70 disposed to the camshaft 10 for elastically supporting the high lift cam 30.

The high lift cam 30 may be disposed as plural, and the lost motion spring 70 is disposed between the high lift cams 30.

The low lift 20 cam may be disposed as a pair, and a low lift cam connecting portion 22 connects the low lift cams 20 to the camshaft 10.

The tappet 60 may be disposed as plural, and each low lift cam contact portion 62 is oppositely disposed.

Hereinafter, operations of the variable valve lift apparatus according to the exemplary embodiment of the present invention will be described.

In a low lift mode, as shown in FIG. 3, the oil supply line 42 is not supplied oil, so that the latching pin 48 is separated from the latching pin hole 44 by elastic force of the return spring 50 and thus, the camshaft 10 is released from the high lift cam 30.

So, the tappet 60 reciprocates according to contact of the low lift cam 20 and the low lift cam contact portion 62 and a valve 80 is opened.

In this case, valve lift is relatively lowered, and the high lift cam 30 is deactivated (lost motion) by the lost motion spring 70.

When operating mode is changed from the low lift mode to a high lift mode according to engine operation condition, an ECU (engine control unit, not shown) controls to supply oil to the oil supply line 42, and the supplied oil pushes a pin cap 51, disposed to an end of the latching pin 48, via the penetrating slot 46. And the latching pin 48 is inserted into the latching pin hole 44.

And thus, the camshaft 10 and the high lift cam 30 are connected, and the tappet 60 reciprocates according to contact of the high lift cam 30 and the high lift cam contact portion 64 and the valve 80 is opened. That is, valve lift is relatively increased.

The penetrating slot 46 may be formed through a processing hole 52. If the penetrating slot 46 is formed through the processing hole 52, the processing hole 52 is closed for the latching pin 48 not to be inserted into the processing hole 52.

The low lift cam 20 as a pair is connected by the low lift cam connecting portion 22, the tappet 60 is disposed as plural, and each low lift cam contact portion 62 is oppositely disposed. Also, the high lift cam 30 is disposed as plural and the lost motion spring 70 is disposed between the high lift cams 30 so that numbers of elements as well as manufacturing cost may be reduced.

Also, height of the variable valve lift apparatus may be lowered with simple scheme, and thus, height of an engine may be lowered.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus comprising:

a camshaft;

a plurality of low lift cams which is are connected to the camshaft and rotate;

a plurality of high lift cams which are mounted on the camshaft and rotatable with respect to the camshaft, wherein the high lift cams are selectively connected to the camshaft to rotate with the camshaft;

a high lift cam connecting portion which selectively connects the high lift cams to the camshaft; and a tappet comprising a low lift cam contact portion contacting the low lift cam and a high lift cam contact portion selectively activating the high lift cam;

wherein the high lift cam contact portion includes a slanted portion which is protruded from the low lift cam contact portion and shaped as a curved surface;

wherein exterior surfaces of the high lift cams are slanted corresponding to the slanted portion; and wherein a lost motion spring is disposed on the camshaft between the high lift cams mounted on the camshaft for elastically biasing the high lift cams along an axial direction of the camshaft.

2. The variable valve lift apparatus of claim 1, wherein the high lift cam connecting portion comprises:

an oil supply line formed in the camshaft having a latching pin guide hole;

a latching pin hole formed to the high lift cams; and a latching pin which is supplied hydraulic pressure from the oil supply line and is selectively locked into the latching pin hole of the high lift cams through the latching pin guide hole of the camshaft.

3. The variable valve lift apparatus of claim 2, wherein the high lift cam connecting portion further comprises:

a penetrating slot formed to the latching pin in a longitudinal direction thereof;

an guide pin which is inserted into the penetrating slot along vertical direction of the moving direction of the latching pin and connected to inner surface of the camshaft; and a return spring which is disposed within the latching pin and elastically biases the latching pin against the guide pin.

4. The variable valve lift apparatus of claim 1, wherein the low lift cams are disposed as a pair, and a low lift cam connecting portion connects the low lift cams.

5. The variable valve lift apparatus of claim 4, wherein each low lift cam contact portion is oppositely disposed.

6. A variable valve lift apparatus comprising:

a camshaft;

a plurality of tappets comprising a low lift cam contact portion and a high lift cam contact portion protruded from the low lift cam contact portion and slantedly formed;

a plurality of low lift cams which are connected to the camshaft, rotate, and selectively contact the low lift cam contact portion;

a plurality of high lift cams which are mounted on the camshaft and rotatable with respect to the camshaft, wherein the high lift cams contacts the high lift cam contact portion, are selectively connected to the camshaft and rotate, and of which an exterior surface is slantedly formed;

a high lift cam connecting portion which selectively connects the high lift cams and the camshaft; and a lost motion spring disposed on the camshaft between the high lift cams mounted on the camshaft for elastically biasing the high lift cams along an axial direction of the camshaft.

7. The variable valve lift apparatus of claim 6, wherein the high lift cam connecting portion comprises:

an oil supply line formed in the camshaft having a latching pin guide hole;

a latching pin hole formed to the high lift cams;

a latching pin which is supplied hydraulic pressure from the oil supply line and is selectively locked into the latching pin hole of the high lift cams through the latching pin guide hole of the camshaft;

a penetrating slot formed to the latching pin in a longitudinal direction thereof;

an guide pin which is inserted into the penetrating slot along vertical direction of the moving direction of the latching pin and connected to inner surface of the camshaft; and a return spring which is disposed within the latching pin and elastically biases the latching pin against the guide pin.

8. The variable valve lift apparatus of claim 7, wherein the low lift cams as a pair are connected by a low lift cam connecting portion, and each low lift cam contact portion is oppositely disposed.

* * * * *